United States Patent [19]

Orth et al.

[11] 4,015,776

[45] Apr. 5, 1977

[54] THERMOSTATIC EXPANSION VALVE

[75] Inventors: Charles D. Orth, Cedarburg; Marcel P. Griffoul, West Allis, both of Wis.

[73] Assignee: The Singer Company, New York, N.Y.

[22] Filed: Jan. 23, 1976

[21] Appl. No.: 651,717

[52] U.S. Cl. ..... 236/92 B; 251/61.3

[51] Int. Cl.[2] ..... G05D 27/00

[58] Field of Search ..... 236/92 B, 99 R; 92/161; 251/61.2, 61.3, 61.4, 61.5, DIG. 1; 62/528; 29/512; 285/DIG. 19, 222, 201, 204

[56] References Cited

UNITED STATES PATENTS

| | | | |
|---|---|---|---|
| 874,652 | 12/1907 | Bailey | 251/DIG. 1 |
| 3,505,724 | 4/1970 | Leitner et al. | 29/512 |
| 3,822,563 | 7/1974 | Orth | 236/92 B |
| 3,930,515 | 1/1976 | Kennedy et al. | 251/61.4 |
| 3,940,837 | 3/1976 | Wiese | 29/512 |

*Primary Examiner*—William E. Wayner
*Assistant Examiner*—Robert J. Charvart
*Attorney, Agent, or Firm*—Michael, Best & Friedrich

[57] ABSTRACT

The thermostatic expansion valve has a valve controlling flow from the inlet to the outlet and is biased to seated position by the compressed spring adustably mounted in the outlet. The valve is actuated by a push pin extending from the underside of the diaphragm pad. The diaphragm is mounted between upper and lower stampings welded together at their periphery. The space above the diaphragm is connected via a capillary tube to a feeler bulb and is part of a charged system the pressure of which varies with temperature at the bulb. The lower head stamping is connected to the valve body by novel means. The upper end of the body is provided with a groove receiving an O-ring. Inside this groove the body is provided with an annular extension outside the push pin hole. The lower head stamping is placed on the body and the annular extension is crimped over the stamping to firmly fix the head on the body while developing high unit pressure on the O-ring to provide an effective seal at low cost. This also allows use of different metals in the head and body.

3 Claims, 2 Drawing Figures

THERMOSTATIC EXPANSION VALVE

BACKGROUND OF THE INVENTION

This invention is directed to the problem of mounting the lower stamping of the diaphragm head assembly to a thermostatic valve body. Most commonly this has been done by silver soldering the head to the body. This procedure involves a considerable amount of labor and requires the use of torches and acid baths in the production area, none of which is desirable. Furthermore, allowance must be made for subsequent finish machine work directly related to the processing involved in the soldering operation and otherwise unnecessary. Thus the method is not very desirable, either from a production, health, or cost standpoint.

Some designs have screwed the head stamping onto the body and sealed the stamping to the body with epoxy or an O-ring. To provide the screw threads on the stamping requires that the stamping have a drawn neck which is difficult to produce and also requires threading the neck which is an added production cost. The net result was a substantially higher cost.

There have been attempts to crimp the head to the body but prior efforts did not get high enough unit pressure to cause an effective seal to be made.

SUMMARY OF THE INVENTION

The object of this invention is to crimp the lower head stamping to a valve body and develop adequate unit pressure on an O-ring seal between the stamping and the body to insure an effective seal. This is accomplished by providing the annular extension surrounding the push pin hole and crimping that extension over the lower head stamping to compress an O-ring mounted in a groove at the end of the valve body close enough to the extension so that the crimping develops adequate pressure on the O-ring to insure a proper seal throughout the service life of the valve.

DESCRIPTION OF THE PREFERRED EMBODIMENT

Figure 2:
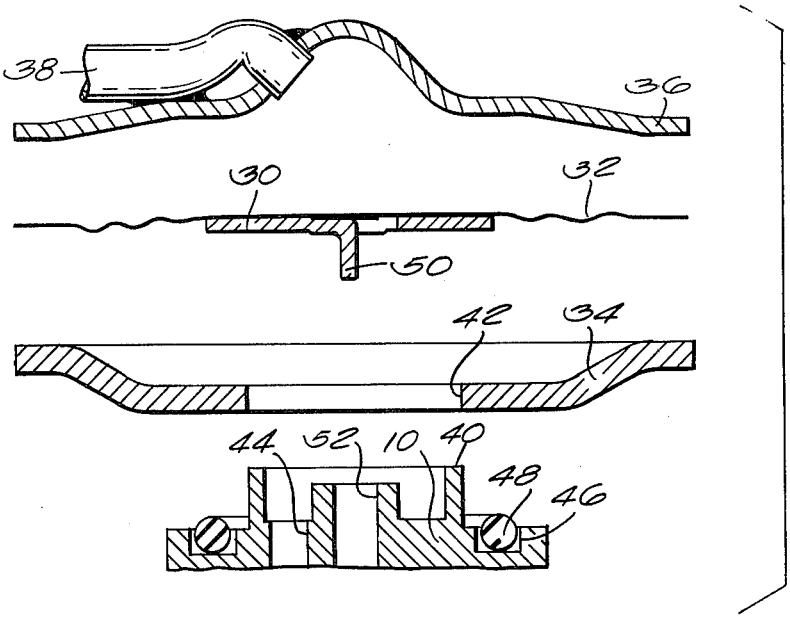
FIG. 2 is a partial, exploded sectional view showing the manner in which the lower head stamping fits over the annular body extension prior to crimping.

Valve body 10 has a threaded inlet 12 to which the line 14 from the receiver or condenser/receiver is connected. A strainer 16 is mounted in the inlet. The outlet 18 is internally threaded to receive the adjustable seat 20 for spring 22 compressed between the seat and cup 24 which supports the ball-type valve 26. Push pin 28 acts against the cup 24 and transmits movement from diaphragm pad 30 fixed on diaphragm 32. Diaphragm 32 is captured between lower head stamping 34 and upper head stamping 36. The perimeter of the head assembly is heliarc welded to form a leak-proof joint. Capillary 38 is fixed to the upper head stamping 36 and leads to the customary feeler bulb (not shown) with the space in the bulb, tube and above the diaphragm charged with a temperature responsive charge so the pressure above the diaphragm varies with temperature at the bulb.

The upper end of the valve body is in manufacture provided with an annular extension 40 (see FIG. 2).

The lower head stamping 34 has a central aperture 42 which fits over the extension 40. The annular extension 40 is outside the hole 44 through which the push pin passes. Immediately outside the extension 40 there is a groove 46 in the top surface of the body 10 and receiving an O-ring 48.

Figure 1:
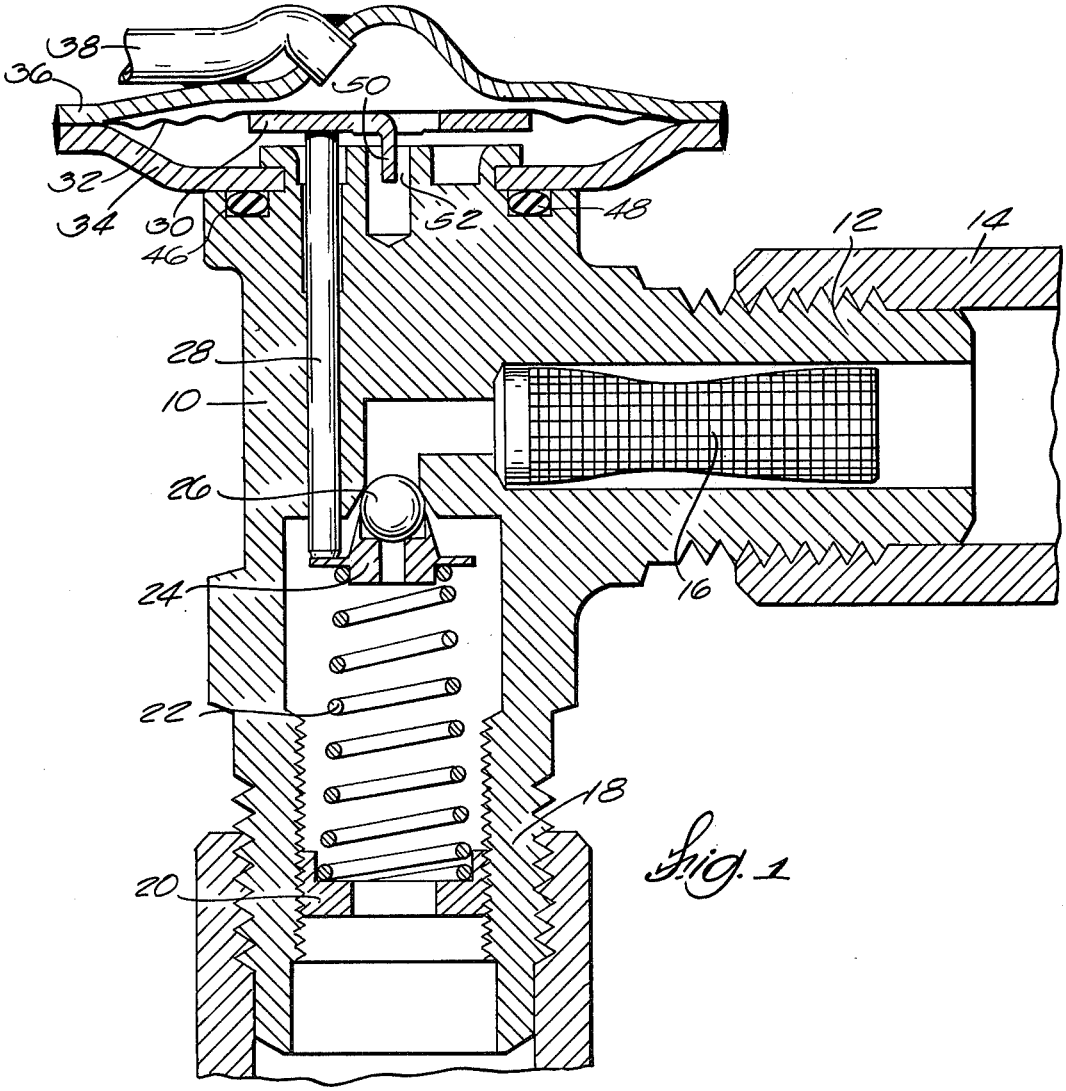
FIG. 1 is a vertical section through a complete valve and illustrating the final assembled form of the valve.

When the head stamping 34 is placed over the extension 40 the extension is crimped over the inside of the head stamping 34 in the manner shown in FIG. 1. This forces the head stamping firmly against the top surface of the valve body and deforms the O-ring 48 with sufficient unit pressure to insure an adequate seal between the head stamping and the valve body. The process results in lower cost than other methods. It is very effective and can be used with the same or dissimilar materials in the head and body.

After the lower head stamping is fixed on the body the assembly of the valve may be completed. The pierced depending central guide 50 of the pad 30 is received in the pilot hole 52 in the upper end of the body. The subsequent operation in securing the diaphragm and the upper head to the lower head by means of welding will not adversely affect the seal already obtained by the crimping process.

This design has a further advantage in that an external equalizer connection to the lower head stamping can be made to extend the capillary from the head in any desired direction at the time of assembly. Thus any customer requirement can be satisfied without requiring special piece parts for each directional requirement.

The valve body may be completely machined before assembly and the tooling required for assembly requires very little floor space.

We claim:

1. A thermostatic expansion valve comprising,
- a valve body having an inlet and an outlet,
- a valve in the body to control flow between the inlet and the outlet,
- a spring biasing the valve to its seated position,
- a diaphragm head assembly mounted on the upper end surface of the valve body, the assembly including upper and lower stampings and a diaphragm mounted between the stampings to define a pressure chamber in the space between the diaphragm and the upper stamping,
- means interconnecting the diaphragm and the valve, the improvement comprising,
- an annular integral extension from said surface received within a corresponding aperture in the lower head stamping,
- an O-ring between said surface and the lower head stamping,
- said extension being crimped outwardly to firmly fix the lower head stamping on the valve body with the O-ring effecting a seal.

2. A thermostatic expansion valve according to claim 1 in which said surface is provided with an annular groove having an inner diameter somewhat greater than the outer diameter of said extension, said O-ring being mounted in the groove and stressed by the lower stamping when said extension is crimped.

3. A thermostatic expansion valve according to claim 2 in which the means connecting the diaphragm and the valve comprises a pin passing through a corresponding aperture in the valve body and located inside the inner diameter of said extension.

* * * * *